US008276952B2

(12) United States Patent
Halliday

(10) Patent No.: US 8,276,952 B2
(45) Date of Patent: Oct. 2, 2012

(54) DOUBLE-DOOR STOP APPARATUS

(76) Inventor: David Halliday, Glasgow (GB)

( * ) Notice: Subject to any disclaimer, the term of this patent is extended or adjusted under 35 U.S.C. 154(b) by 0 days.

(21) Appl. No.: 12/901,583

(22) Filed: Oct. 11, 2010

(65) Prior Publication Data

US 2011/0023269 A1 Feb. 3, 2011

Related U.S. Application Data

(63) Continuation of application No. PCT/GB2009/000905, filed on Apr. 7, 2009.

(30) Foreign Application Priority Data

Apr. 11, 2008 (GB) ..... 0806594.8

(51) Int. Cl.
*E05C 9/00* (2006.01)
*E05C 19/18* (2006.01)

(52) U.S. Cl. ..... 292/338; 292/259 R; 292/288; 292/DIG. 15; 292/DIG. 21

(58) Field of Classification Search ..... 292/1, 256, 292/259 R, 288, 338, DIG. 15, DIG. 21; 16/82
See application file for complete search history.

(56) References Cited

U.S. PATENT DOCUMENTS

| | | | | | |
|---|---|---|---|---|---|
| 70,726 | A * | 11/1867 | Lightfoot | 292/259 R |
| 122,655 | A * | 1/1872 | Rockwood | 292/259 R |
| 386,423 | A * | 7/1888 | Cornell | 292/259 R |
| 1,528,834 | A * | 3/1925 | Leist-Wettler | 292/262 |
| 2,560,860 | A | 7/1951 | Hannegan | |
| 4,335,910 | A * | 6/1982 | Massie | 292/259 R |
| D349,638 | S * | 8/1994 | Gutierrez | D8/331 |
| 6,370,741 | B1 * | 4/2002 | Lu | 24/523 |
| 6,550,828 | B2 * | 4/2003 | Warden | 292/288 |
| 6,619,708 | B1 * | 9/2003 | Naylor | 292/259 R |
| 6,802,483 | B1 * | 10/2004 | Leasure | 248/229.15 |
| 6,834,896 | B2 * | 12/2004 | Smith | 292/259 R |

FOREIGN PATENT DOCUMENTS

| | | |
|---|---|---|
| DE | 202006017281 | 2/2007 |
| GB | 193764 | 3/1923 |
| GB | 2106174 A * | 4/1983 |
| JP | 11041721 | 2/1999 |

OTHER PUBLICATIONS

GB Search Report of patent application No. GB0806594.8, Aug. 6, 2008.
International Search Report of PCT patent application No. PCT/GB2009/000905, Jul. 7, 2009.
GB Examination Report of Patent Application No. GB0806594.8, Feb. 15, 2012.

* cited by examiner

*Primary Examiner* — Carlos Lugo

(57) ABSTRACT

Double-door stop apparatus comprises a rigid elongate bar element which has a length which spans a distance between open oppositely-hinged double doors, and attachment elements on the bar element for releasably fastening the bar element to each of the doors. In use, the double doors are thus securely held stationary in an open condition. Preferably, the apparatus further comprises an awning sheet of flexible material which is extendable from the bar element.

14 Claims, 3 Drawing Sheets

DOUBLE-DOOR STOP APPARATUS

CROSS-REFERENCE TO RELATED PATENT APPLICATION

The present patent application is a continuation patent application of International Patent Application No. PCT/GB2009/000905 filed Apr. 7, 2009, which claims priority of GB Patent Application No. 0806594.8 filed Apr. 11, 2008, the entire contents of which are incorporated herein by reference.

BACKGROUND

The present patent application relates to apparatus for securely and releasably holding double-doors in an open condition.

Double doors are used in a wide variety of environments, from providing access to domestic patios and verandas to access to commercial seating areas for pubs, restaurants and other entertainment venues. Double doors are often situated in exterior walls, but are also commonly found in internal walls between adjoining rooms.

The problem with double doors is holding them safely in an open condition. This is especially so during good weather when people want to move, often frequently, between an interior location and an exterior location, for example to access a barbeque on a patio, or during social events held between interconnecting rooms. It is often a cause of accidents that a person, particularly a child, will walk or run into a partially open door. Furthermore, often wind will cause an open exterior door to slam shut, again creating potential hazards.

To overcome these problems, the traditional solution is to keep the double doors closed. This is undesirable, and the present patent application seeks to overcome these problems.

SUMMARY

According to the present patent application, there is provided double-door stop apparatus comprising a rigid elongate bar element which has a length for spanning a distance between open oppositely-hinged double doors, and attachment means on the bar element for releasably fastening the bar element to each of the doors, so that in use the double doors are securely held stationary in an open condition.

BRIEF DESCRIPTION OF THE DRAWINGS

The present patent application will now be more particularly described, by way of example only, with reference to the accompanying drawings, in which.

DETAILED DESCRIPTION

Figure 1:
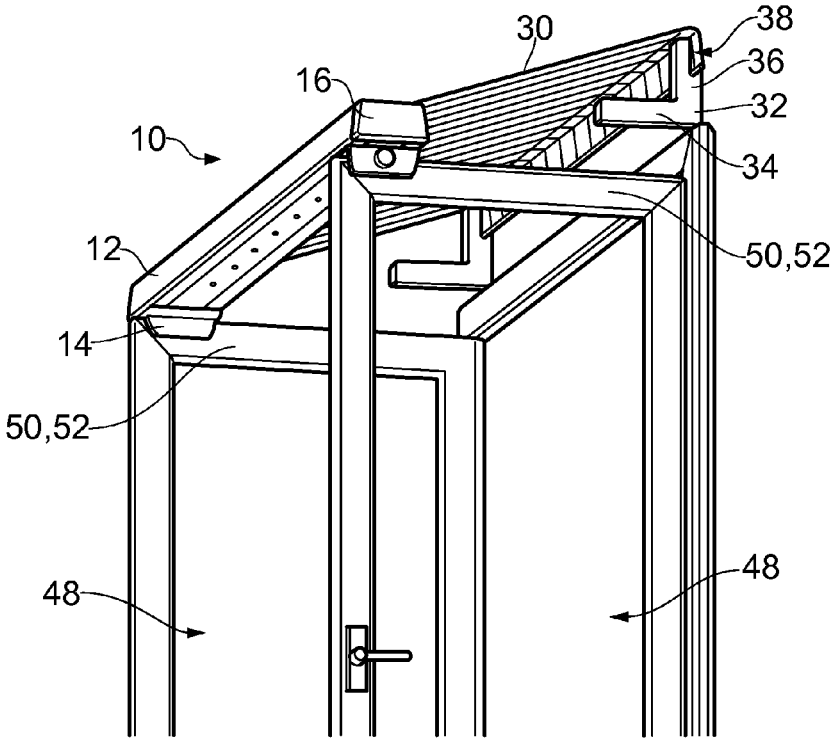
FIG. 1 shows a perspective view of one embodiment of double-door stop apparatus, in accordance with the present patent application and shown in an in use condition.
Figure 2:
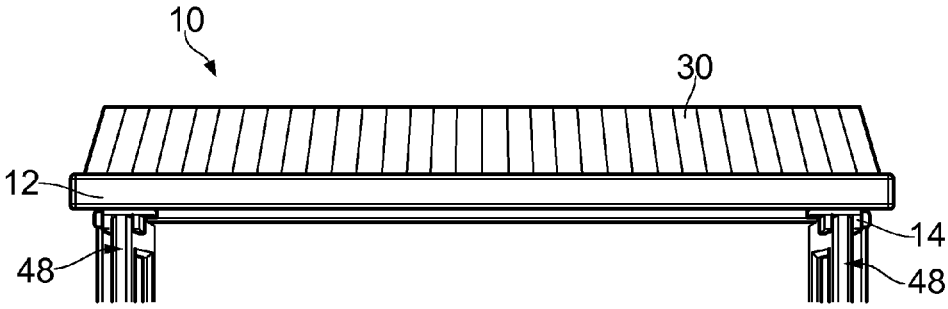
FIG. 2 shows a front view of the double-door stop apparatus.
Figure 3:
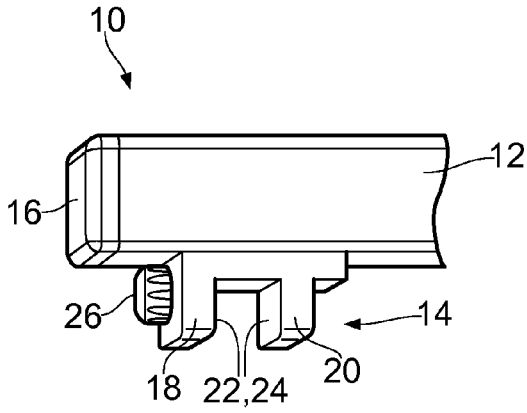
FIG. 3 shows an enlarged view of one end of the double-door stop apparatus, showing attachment means.
Figure 4:
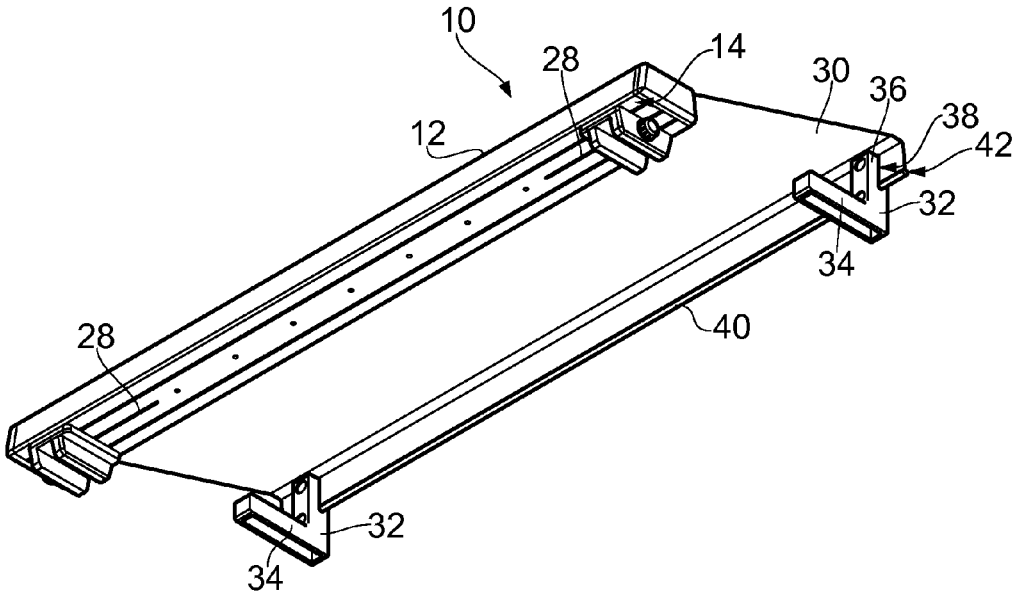
FIG. 4 shows a perspective view from below of the double-door stop apparatus, in an in use condition.
Figure 5:
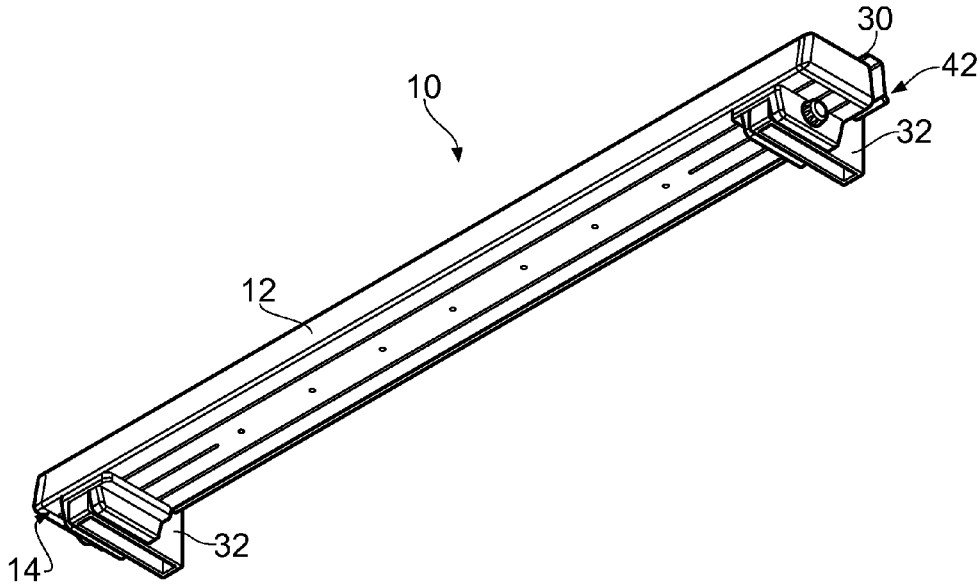
FIG. 5 shows a perspective view from below of the double-door stop apparatus, in a stored condition.

Referring to the drawings, there is shown double-door stop apparatus 10 which comprises a rigid fixed elongate bar element 12 and two clamp devices 14 provided at each end of the bar element 12.

The bar element 12 is formed from plastics or light-weight metal material, such as aluminium, and is a one-piece hollow tube having end caps 16 at each end. Each clamp device 14 has an L-shaped base 18 and a clamping plate 20 which is movable along the base 18. Opposing surfaces of the clamping plate 20 and the base 18 thus form clamping surfaces 22. Preferably, the clamping surfaces 22 have a protective lining or coating 24, for example, an elastomer such as rubber or plastics, in order to prevent damage to an item being clamped to.

A thumb-screw 26 is rotatably mounted to the L-shaped base 18 in order to alter a position of the clamping plate 20.

Each clamp device 14 is slidably mounted to an in use underside of the bar element 12. Although, in this embodiment, a track 28 for each clamp device 14 only extends a relatively short distance from its respective end to allow the clamp device 14 to slide therealong, it is entirely feasible that a track can be provided which extends the entire or substantially entire length of the bar element 12. As such, in this latter case, only a single track may be provided and both clamp devices 14 can be mounted thereon.

Once a required position of each clamp device 14 is determined, the clamp devices 14 are fixed in place by a locking bolt not shown which simply projects through the base 18 of the clamp device 14 and is releasably screw-threadably fastened in the bar element 12.

However, a ratchet mechanism or sprung thumb-catch could also be used instead of the locking bolt.

In this embodiment, the hollow bar element 12 is provided with a roller mechanism not shown therein, and an awning sheet 30 which is wound by the roller mechanism. Preferably, the roller mechanism is sprung so that the awning sheet 30 is automatically wound back into the interior of the bar element 12 once released. However, it is feasible that the roller mechanism could be manually operable, for example, via a chain or cord drive. Beneficially, a roller mechanism similar to those used in conventional roller blinds could be utilised.

For storage, the double-door stop apparatus 10 is also provided with two L-shaped surface-mountable support brackets 32. The support brackets 32 are, for example, fastened to an adjacent wall in spaced relationship. The spacing between the brackets 32 is preferably the same as the spacing between the clamp devices 14, so that the bar element 12 can be simply seated on the projecting arms or support members 34 of the support brackets 32 and fastened thereto via the clamp devices 14.

The upright 36 of each support bracket 32 includes an in use vertical slot 38 for releasably received a free distal edge 40 of the awning sheet 30. An elongate pin 42 is provided laterally in the slot 38 to wedge or retain the free distal edge 40 of the awning sheet 30 in the slot 38 of each support bracket 32. To release the awning sheet 30 from the slot 38, the elongate pin 42 is withdrawn from the respective support bracket 32 in a lateral direction.

Advantageously, at least one light-emitting element 44 is provided on or in the bar element 12. Preferably, a plurality of the light-emitting elements 44 is provided in spaced relationship along an underside of the bar element 12. The or each light-emitting element 44 can be an LED lamp, which is extremely energy efficient whilst providing good ambient down-lighting.

Figure 6:
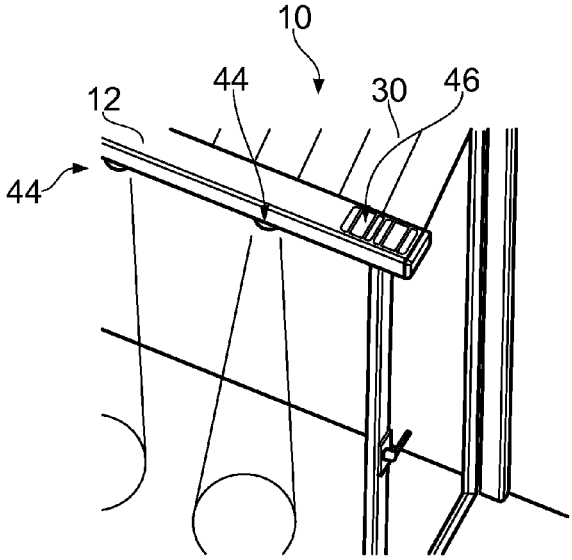
FIG. 6 shows a part of the double-door stop apparatus from above, showing optional solar panels.

To run the or each light-emitting element 44, one or more solar panels 46 can be provided on an upwardly facing surface of the bar element 12. These are shown in FIG. 6.

The above-described double-door stop apparatus 10 is intended for use with external outwardly-opening double doors 48, for example, which provide access to a garden area or patio. As such, in use, the double doors 48 are placed in their open condition, the clamp devices 14 are released from the respective arms 34 of the support brackets 32, and the bar element 12, which is dimensioned to span at least a distance between the opposing hinges of the two doors 48, is lifted clear of the support brackets 32 and placed on the upper horizontal cross-members or headers 50 of the door frames such that the clamp devices 14 are interposed therebetween. The dragging of the bar element 12 onto the frames unfurls the awning sheet 30, forming a temporary awning. The clamp devices 14 are then operated via the thumb-screws 26 to close the protective clamping surfaces 22 onto the sides 52 of the header or jamb of the frame of the door. Once clamped and thus fastened in place, the apparatus 10 securely and releasably holds the double doors 48 open and stationary relative to each other, and the awning sheet 30 advantageously provides a sun shade.

Once erected and during the evening, the light-emitting elements 44 provide convenient ambient lighting. Even in the stored condition, the light-emitting elements 44 can still be utilised.

Although the double-door stop apparatus has been described above as including a roller mechanism and associated awning sheet, the roller mechanism and awning sheet may be optional. As such, the apparatus can simply be provided with the bar element and the clamp devices. In this arrangement, the apparatus is simply utilised as a door stop which holds two doors swinging in opposite directions in a stationary open condition. In this latter arrangement, the bar element may be telescopic. Consequently, the clamp devices may be fixed in place.

The phrase 'open condition' as used above is intended to mean a position at which each door is at least perpendicular to the associated doorway.

The clamp devices described above are mechanically operable by the user. However, one or both clamping surfaces of one or both clamp devices could potentially be provided on a sprung jaw or jaws, enabling the thumb-screw to be dispensed with.

The or each clamp device may also have a quick release mechanism, so that a user can easily and quickly release the apparatus from the support bracket and/or the door frames.

Since the bar element conveniently spans a distance between open oppositely-hinged double doors, especially for exterior doors, optional devices can be suspended therefrom. In this case, a flying-insect deterrent device, such as a fly screen, can be suspended from the bar element.

In a further modification, the double-door stop apparatus can be used as a barrier to prevent access through the open doors. In this case, the bar element can be clamped partway up the vertical uprights of the doors in order to span therebetween. Typically, for example, this would be at waist height. As an option, the awning sheet can be replaced by a pull down barrier sheet. Alternatively or additionally, a warning sign can be suspended from the bar element.

Although clamp devices are described above, any suitable attachment means can be provided for releasably fastening the bar element to each of the doors. For example, for use with multi-point locks, a bar element with keyways which releasably latch over a top sliding lock can be used instead of the clamp devices. As a further alternative, a keyway channel can be provided along the top of each door allowing sliding engagement with a mating projection on the underside of the bar element.

It is therefore possible to provide double-door stop apparatus which can securely hold double doors stationary in an open condition. It is also possible to provide double-door stop apparatus which includes a retractable awning. Furthermore, double-door stop apparatus can be provided for use as a barrier.

The embodiments described above are provided by way of examples only, and various other modifications will be apparent to persons skilled in the art without departing from the scope of the appended claims.

What is claimed is:

1. An apparatus for interacting with a pair of open oppositely-hinged double doors, comprising:

a rigid elongated bar element having a length for spanning a distance formed by the open doors, the bar element having a bottom attachment surface;

a pair of attachment elements movable attached on bottom surface of the bar element to releasable fasten the bar element to a top surface of each open door, so that in use the double doors are securely held stationary in an open condition;

a pair of support members configured to be positioned on a respective door frame of the double doors; and an awning sheet of flexible material having one end mounted on the bar element and extending toward an opposite end engaged to the at least one support element, when extended, the awning sheet provides a covered area between the oppositely-hinged double doors when in the open position.

2. The apparatus for interacting with a pair of open oppositely-hinged double doors as claimed in claim 1, wherein the attachment elements comprise a releasable clamp device which is engagable with an upper edge of the double doors and which is at or adjacent to each end of the bar element.

3. The apparatus for interacting with a pair of open oppositely-hinged double doors as claimed in claim 2, wherein each clamp device is selectively positionable on the bar element by sliding in a track on the bar element.

4. The apparatus for interacting with a pair of open oppositely-hinged double doors as claimed in claim 2, wherein each clamp device includes protective clamping surfaces.

5. The apparatus for interacting with a pair of open oppositely-hinged double doors as claimed in claim 2, wherein at least one of the clamp devices includes a rotatable thumb-screw for moving clamping surfaces relative to each other.

6. The apparatus for interacting with a pair of open oppositely-hinged double doors as claimed in claim 2, wherein at least one of the clamp devices includes sprung jaws for gripping a door.

7. The apparatus for interacting with a pair of open oppositely-hinged double doors as claimed in claim 1, wherein the bar element is hollow.

8. An apparatus for interacting with a pair of open oppositely-hinged double doors, comprising:

a rigid elongated bar element having a length for spanning a distance formed by the open doors, the bar element having a bottom attachment surface;

a pair of attachment elements movable attached on bottom surface of the bar element to releasable fasten the bar element to a top surface of each open door, so that in use the double doors are securely held stationary in an open condition;

first and second support members to be positioned on a wall above a respective door frame of the double doors; and an awning sheet of flexible material having one end mounted on the bar element and extending toward an opposite end engaged to the at least one support element, when extended, the awning sheet provides a covered area between the oppositely-hinged double doors when in the open position.

9. The apparatus for interacting with a pair of open oppositely-hinged double doors as claimed in claim 8, wherein the attachment elements comprise a releasable clamp device which is engagable with an upper edge of the double doors and which is at or adjacent to each end of the bar element.

10. The apparatus for interacting with a pair of open oppositely-hinged double doors as claimed in claim 9, wherein each clamp device is selectively positionable on the bar element by sliding in a track on the bar element.

11. The apparatus for interacting with a pair of open oppositely-hinged double doors as claimed in claim 9, wherein each clamp device includes protective clamping surfaces.

12. The apparatus for interacting with a pair of open oppositely-hinged double doors as claimed in claim 9, wherein at least one of the clamp devices includes a rotatable thumbscrew for moving clamping surfaces relative to each other.

13. The apparatus for interacting with a pair of open oppositely-hinged double doors as claimed in claim 9, wherein at least one of the clamp devices includes sprung jaws for gripping a door.

14. The apparatus for interacting with a pair of open oppositely-hinged double doors as claimed in claim 8, wherein the bar element is hollow.

* * * * *